United States Patent [19]

Khosropour

[11] 4,226,173

[45] Oct. 7, 1980

[54] PROTECTIVE CAP FOR AN EXHAUST PIPE

[75] Inventor: Mostafa M. Khosropour, Oregon, Wis.

[73] Assignee: Nelson Industries, Inc., Stoughton, Wis.

[21] Appl. No.: 36,286

[22] Filed: May 7, 1979

[51] Int. Cl.[3] ..... F23L 17/02

[52] U.S. Cl. ..... 98/59; 220/334; 220/85 P; 137/382

[58] Field of Search ..... 220/85 P, 334; 137/382, 137/527.6; 138/89; 98/59

[56] References Cited

U.S. PATENT DOCUMENTS

| | | | |
|---|---|---|---|
| 3,523,499 | 8/1970 | Bauerschmidt et al. | 98/59 |
| 3,847,297 | 11/1974 | Baader et al. | 220/85 P |

*Primary Examiner*—George T. Hall

*Attorney, Agent, or Firm*—Andrus, Sceales, Starke & Sawall

[57] ABSTRACT

A protective cap for an exhaust pipe. A U-shaped clamp is disposed around the exhaust pipe adjacent its outer end and an arm which carries a lid is pivoted to the free ends of the clamp. The lid is adapted to enclose the outer end of the exhaust pipe and can be moved to an open position by the pressure of the exhaust gas. A stop is mounted on the ends of the clamp at a position between the pivot and the exhaust pipe, and is adapted to be engaged by the lower thin edge of the arm to limited downward movement of the lid and space the lid from the end of the pipe to reduce noise.

3 Claims, 2 Drawing Figures

PROTECTIVE CAP FOR AN EXHAUST PIPE

BACKGROUND OF THE INVENTION

Protective caps, commonly referred to as weather caps or rain caps, are frequently used with the vertical exhaust pipes of construction or off-road equipment to prevent rain, snow and other materials from entering the exhaust pipe during periods of non-operation. The typical protective cap is hinged to the upper end of the exhaust pipe and is counterweighted to the closed position. On operation of the engine, the increase of pressure in the exhaust pipe will move the cap to the open position.

The conventional pressure responsive cap is subject to vibration of the engine and/or vehicle which induces fatigue in the components of the cap, with the result that the cap may have a limited life of service. The conventional cap is also noisy during engine idling due to the impact of the cap on the clamp and/or exhaust pipe.

In an attempt to reduce noise from the cap, it has been proposed, as described in U.S. Pat. No. 3,523,499 to provide a stop for the cover or lid, so that the lid will be spaced slightly out of contact with the outer end of the exhaust pipe when it is in the closed position. To provide this function, the aforementioned patent includes a clamping ring that is attached to the outer end of the exhaust pipe and a curved crank leg extends upwardly from the clamping ring to a location beyond the outer end of the exhaust pipe. Pivoted to the outer end of the crank leg is an arm which supports a cover or lid, and the arm carries a stop pin which engages a plate mounted on the upper end of the crank leg. With the construction as shown in U.S. Pat. No. 3,523,499, engagement of the stop pin with the plate will space the cover out of contact with the end of the exhaust pipe, when the cover is in the closed position, to thereby reduce vibrational rattling.

SUMMARY OF THE INVENTION

The invention is directed to an improved and simplified protective cap for an exhaust pipe, and particularly to a cap to be used with the vertical exhaust pipe of agricultural, or off-road equipment.

In accordance with the invention, the cap includes a generally U-shaped clamp which is disposed around the outer end of the pipe and an arm is pivoted to the free ends or legs of the clamp by a pivot pin. The arm carries a cover or lid which is adapted to be moved by the pressure of the exhaust gas from a closed position, where it encloses the outer end of the exhaust pipe, to an open position.

To limit the pivotal movement of the arm and cover, a stop is connected to the legs of the U-shaped clamp at a location between the pivot pin and the exhaust pipe. The lower edge of the arm is adapted to engage the stop, when the cover is in the closed position, to thereby space the cover from the outer end of the exhaust pipe and prevent impact noise. When the cover is opened, by virtue of an increase in pressure within the exhaust pipe, a second portion of the lower edge of the arm will engage the stop to limit the open position of the cover.

With the protective cap of the invention, a single stop is employed to limit both the closed and open positions of the cover. The stop is located so that when the cover is in the closed position it will be spaced slightly out of contact with the outer end of the exhaust pipe to thereby prevent metal-to-metal contact and minimize rattling and vibration.

The clamping ring serves a multiple function in that it not only serves to secure the unit to the exhaust pipe, but also carries the pivot pin as well as the stop.

As an edgewise contact is provided between the arm and the stop pin, there is a lesser contact area than that of conventional protective caps and this further reduces the noise and vibration.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
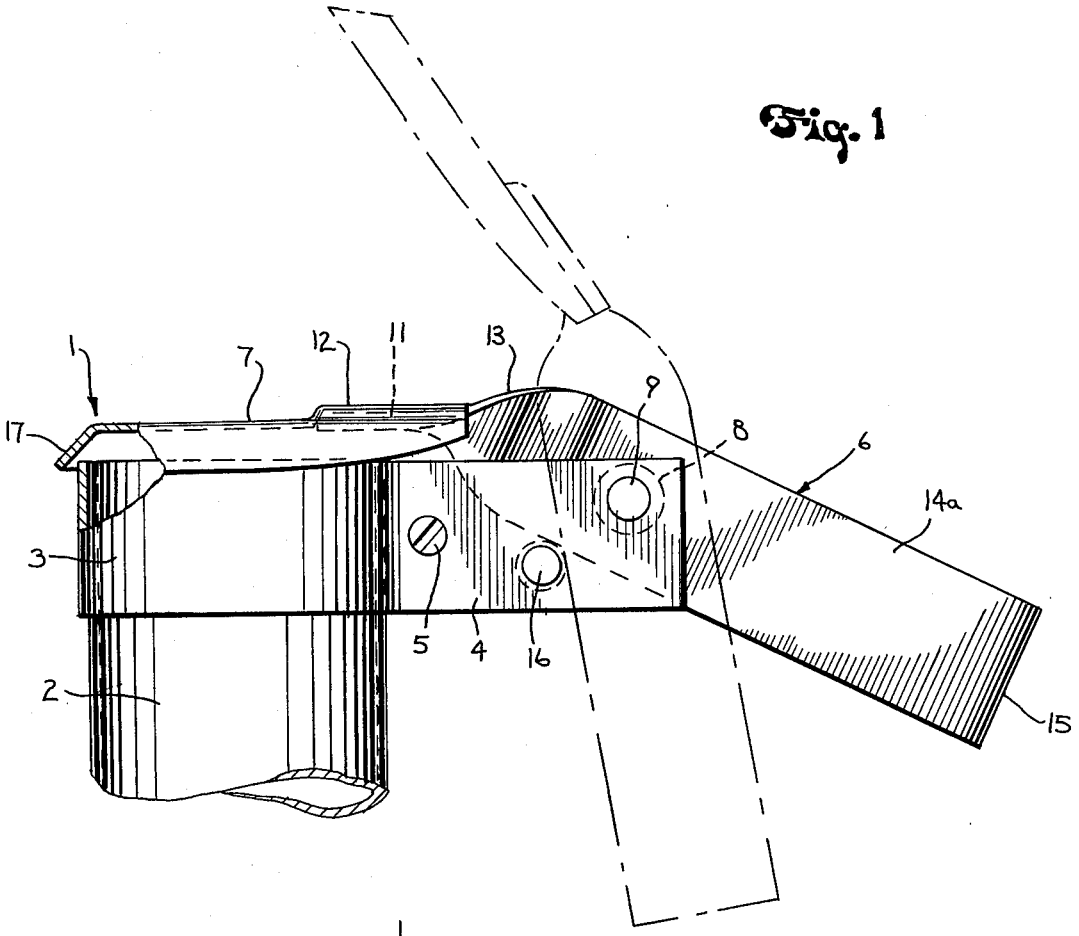
FIG. 1 is a side elevation of the protective cap of the invention as connected to a vertical exhaust pipe, with parts broken away in section.

The drawings illustrate a protective cap 1 which is connected to the outer end of an exhaust pipe 2, such as used with off-road or agricultural equipment. The cap 1 includes a generally U-shaped clamping strap 3 which is engaged with the outer surface of the pipe 2 adjacent its outer end, and the clamp includes a pair of outwardly extending generally parallel ends or legs 4. The clamping strap is secured around the pipe 2 by a bolt 5.

Figure 2:
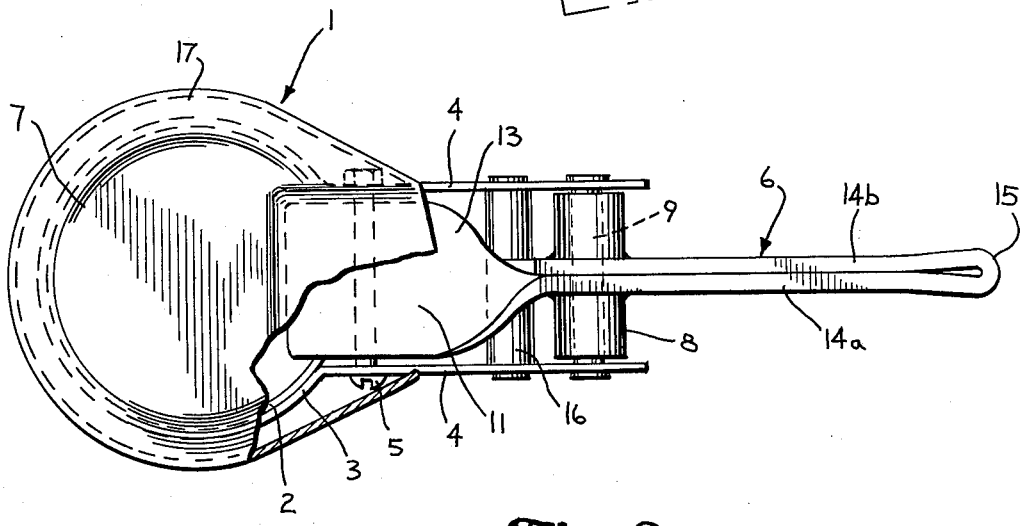
FIG. 2 is a top plan view of the cap shown in FIG. 1 with parts broken away.

The arm 6, which carries a lid or cover 7, is pivoted to the outer ends of the legs 4. To provide the pivotal connection, a bushing 8 is secured within an opening in the arm 6 and the bushing is journalled around a pivot pin 9 that extends between the legs 4. As best shown in FIG. 2, each end of the pin 9 has a reduced diameter and extends through an opening in the respective leg. The outer projecting ends of the pin are staked radially outward to retain the pin between the legs 4.

The inner end of the arm 6 is generally flat, as indicated by 11, and is secured flatwise to an upwardly offset portion 12 of the cover 7. The central portion 13 of the arm is provided with a twist so that the outer section 14 lies in substantially vertical plane and extends downwardly and outwardly when the cover is in the closed position. As best shown in FIG. 2, the outer section 14 is provided with a reverse bend 15 to provide a pair of sections **14*a* and 14*b* which are secured flatwise together. The outer section 14 of arm 6** acts as a counterweight to aid in moving the cover to the open position, and the doubled-back construction reduces the length of the arm for a given weight.

A stop pin 16 is mounted between the legs 4 and is located between the pivot pin 9 and the pipe 2. As shown in FIG. 1, the stop pin is positioned at a lower level than the pivot pin 9 and is disposed to be engaged by the lower edge of the outer section 14 of arm 6.

The stop pin 16 is positioned such that a portion of the lower edge of the outer section 14 of arm 6 will engage the pin when the cover 7 is in the closed position to space the cover from the outer end of the exhaust pipe, as shown in FIG. 1, and thereby eliminate impact noise. When the cover is pivoted upwardly to the open position by an increase of pressure within the exhaust pipe, the arm 6 will pivot to the phantom position in FIG. 1, and a second portion of the lower edge of section 14 will engage the stop pin 16 to provide a stop for the open position of the cover. Thus, the single stop pin 16 serves to determine both the opened and closed positions of the cover.

As best shown in FIG. 1, the peripheral margin of the lid 7 is provided with the downwardly extending sloping skirt 17 which extends downwardly beyond the upper end of the exhaust pipe 2 when the lid is in the closed position and prevents foreign materials from entering the exhaust pipe, even though the cover itself is not in metal-to-metal contact with the exhaust pipe.

The U-shaped clamping member 3 provides a multiple function in that it not only serves to clamp the unit to the exhaust pipe, but also serves to carry the pivot pin 9 and the stop pin 16.

The construction of the arm 6 is also unique, in that the inner section 11 extends in a substantially horizontal plane, when the cover is in the closed position, to provide a substantial area of contact with the undersurface of the cover. The twisted central section enables the outer portion 14 of the arm to lie in a substantially vertical plane and provide a minimum area of contact with the stop pin 16. By doubling back the outer section 14, the length of the outer section can be reduced for the same counterbalancing effect, and the two edges **14*a* and 14*b* provide greater service life on contacting the stop pin 16**.

Various modes of carrying out the invention are contemplated as being within the scope of the following claims particularly pointing out and distinctly claiming the subject matter which is regarded as the invention.

I claim:

1. A protective cap for an exhaust pipe, comprising a generally U-shaped clamping member having a curved section disposed around the outer surface of an exhaust pipe adjacent the outer end thereof and having a pair of legs extending outwardly from the curved section, an arm, a cover secured to the arm and movable between a closed position where it encloses the outer end of the exhaust pipe to an open position, said arm including an inner section secured flatwise to the cover and lying in a substantial horizontal plane when the lid is in the closed position, said arm also including an outer section extending in a substantially vertical plane, and a twisted central section connecting the inner and outer sections, pivot means for pivotally connecting the outer section of said arm to said legs, and a stop mounted on said legs and disposed between said pivot means and said curved section in a position to be engaged by a first portion of the outer section of said arm to limit downward movement of the cover and space the cover our of contact with the outer end of the exhaust pipe when the cover is in the closed position, said stop being positioned to be engaged by a second portion of the outer section of the arm on opening of the cover to limit the open position of the cover.

2. A protective cap for an exhaust pipe, comprising a generally U-shaped clamp having a curved section disposed around the outer surface of the exhaust pipe adjacent the upper end of said pipe and having a pair of generally parallel spaced legs extending outwardly from the curved section, connecting means for connecting the legs together to secure the clamp to the exhaust pipe, an elongated cover support member, a cover secured to the inner end of the support member and movable between a closed position where the cover encloses the upper end of the exhaust pipe to an open position, pivot means for pivoting the support member to said legs, said suport member extending downwardly and outwardly from the cover when the cover is in a closed position, and a stop connected to said legs and located between said pivot means and said connecting means, said stop position to be engaged by a first portion of the lower edge of the support member to limited downward movement of the cover and space the cover out of metal-to-metal contact with said exhaust pipe when the cover is in the closed position, said stop also positioned to be engaged by a second portion of the lower edge of the support member on opening movement of the cover to thereby limit the open position of the cover.

3. The protective cap of claim 1, wherein the outer section is composed of a pair of flat strips disposed flatwise to each other and connected together by a reverse bend.

* * * * *

UNITED STATES PATENT AND TRADEMARK OFFICE

CERTIFICATE OF CORRECTION

PATENT NO. : 4,226,173

DATED : October 7, 1980

INVENTOR(S) : MOSTAFA M. KHOSROPOUR

It is certified that error appears in the above-identified patent and that said Letters Patent are hereby corrected as shown below:

Abstract, Line 9, Cancel "limited" and substitute therefore ---limit---; Column 3, Line 43, CLAIM 1, Cancel "lid" and substitute therefor ---cover---; Column 4, Line 9, CLAIM 1, Cancel "our" and substitute therefor ---out---; Column 4, Line 32, CLAIM 2, Cancel "limited" and substitute therefor ---limit---.

Signed and Sealed this

*Tenth* Day of *March 1981*

[SEAL]

*Attest:*

RENE D. TEGTMEYER

*Attesting Officer*

*Acting Commissioner of Patents and Trademarks*